US010406814B2

(12) United States Patent
Suzuki

(10) Patent No.: US 10,406,814 B2
(45) Date of Patent: Sep. 10, 2019

(54) LIQUID DISCHARGE HEAD AND LIQUID DISCHARGE DEVICE

(71) Applicant: TOSHIBA TEC KABUSHIKI KAISHA, Tokyo (JP)

(72) Inventor: Isao Suzuki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/877,787

(22) Filed: Jan. 23, 2018

(65) Prior Publication Data

US 2018/0257377 A1 Sep. 13, 2018

(51) Int. Cl.
*B41J 2/14* (2006.01)
*B41J 2/155* (2006.01)

(52) U.S. Cl.
CPC ..... *B41J 2/155* (2013.01); *B41J 2/14209* (2013.01); *B41J 2/14274* (2013.01); *B41J 2002/14475* (2013.01); *B41J 2202/11* (2013.01); *B41J 2202/12* (2013.01)

(58) Field of Classification Search
CPC .... B41J 2/155; B41J 2/14209; B41J 2/14274; B41J 2002/14475; B41J 2202/12; B41J 2202/11
See application file for complete search history.

(56) References Cited

U.S. PATENT DOCUMENTS 9,346,268 B2 5/2016 Suzuki
9,446,591 B2 9/2016 Suzuki
9,669,629 B2 * 6/2017 Suzuki ..... B41J 2/14201
2001/0043243 A1 11/2001 Tachihara et al.
2017/0113457 A1 4/2017 Suzuki et al.
2017/0113460 A1 4/2017 Suzuki et al.

FOREIGN PATENT DOCUMENTS

EP 3028859 A2 6/2016
JP H10138469 A 5/1998
JP H10315463 A 12/1998
JP 2002292862 A 10/2002
JP 2002292866 A 10/2002
JP 2004098579 A 4/2004
JP 2012111087 A 6/2012

OTHER PUBLICATIONS

Machine Translation of JP 10-315463 A "Recording Head", Togashi, Shigemi et al., Paragraph 0017, Figs. 1 and 6 (Year: 1998).*
IP.com search (Year: 2018).*
Extended European Search Report dated Jul. 18, 2018, mailed in counterpart European Application No. 18158302.2, 11 pages.

* cited by examiner

*Primary Examiner* — Lisa Solomon
(74) *Attorney, Agent, or Firm* — Kim & Stewart LLP

(57) ABSTRACT

According to one embodiment, a liquid discharge head includes a pressure chamber, and a nozzle plate having a plurality of nozzle holes formed therein and a discharge face with an upstream side and a downstream side, the plurality of nozzle holes being in fluid communication with the pressure chamber and including a first nozzle hole on the upstream side of the discharge face, and a second nozzle hole on the downstream side of the discharge face. A liquid discharge speed from the first nozzle hole is higher than a liquid discharge speed from the second nozzle hole.

18 Claims, 8 Drawing Sheets

LIQUID DISCHARGE HEAD AND LIQUID DISCHARGE DEVICE

CROSS-REFERENCE TO RELATED APPLICATION

This application is based upon and claims the benefit of priority from Japanese Patent Application No. 2017-045362, filed Mar. 9, 2017, the entire contents of which are incorporated herein by reference.

FIELD

Embodiments described herein relate generally to liquid discharging heads and liquid discharging devices.

BACKGROUND

A liquid discharge head, such as an inkjet head, typically includes a nozzle plate with a plurality of nozzle holes formed therein and a base plate that is disposed so as to face the nozzle plate. The base plate provides a plurality of pressure chambers that is connected to the nozzle holes and a common chamber. By changing pressure in the pressure chambers by applying a voltage to driving elements, which are provided in the pressure chambers, liquid can be discharged from the nozzle holes. A liquid holding tank is connected to the liquid discharge head, and liquid is circulated in a circulation path passing through the liquid discharge head and the liquid holding tank.

In such a liquid discharge head, there is a known configuration in which several nozzle holes communicate with one pressure chamber. In this case, if liquid is ejected towards a discharge target object that moves relative to the liquid discharge head, ejected droplets may hit the target object at slightly different locations due to target movement or ejected droplets may be elongated in a particular direction paralleling the target movement direction.

DETAILED DESCRIPTION

In general, according to one embodiment, a liquid discharge head includes a pressure chamber, and a nozzle plate having a plurality of nozzle holes formed therein and a discharge face with an upstream side and a downstream side, the plurality of nozzle holes being in fluid communication with the pressure chamber and including a first nozzle hole on the upstream side of the discharge face, and a second nozzle hole on the downstream side of the discharge face. A liquid discharge speed from the first nozzle hole is higher than a liquid discharge speed from the second nozzle hole.

Figure 1:
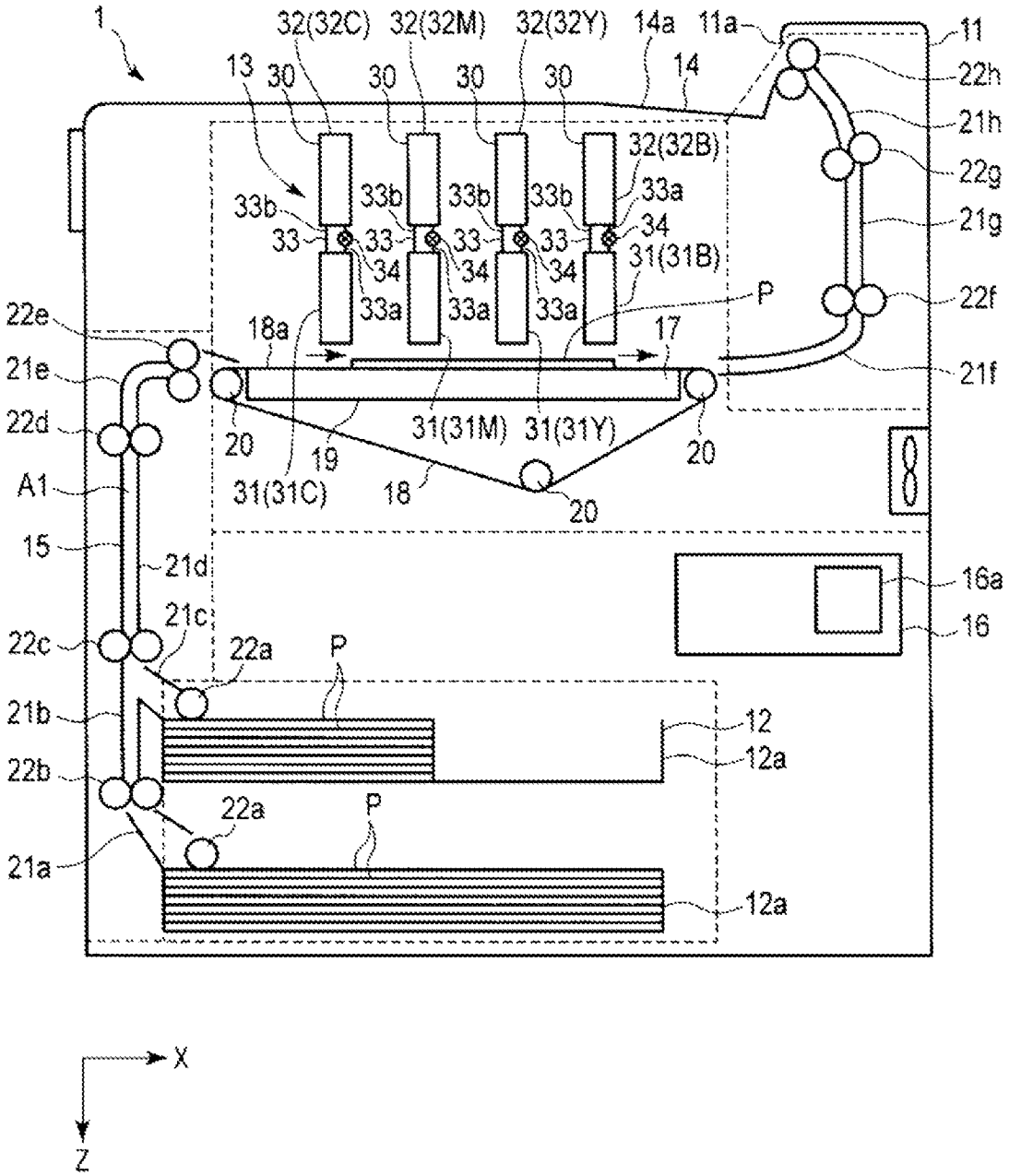
FIG. 1 is an explanatory diagram of a liquid discharge device according to a first embodiment.
Figure 2:
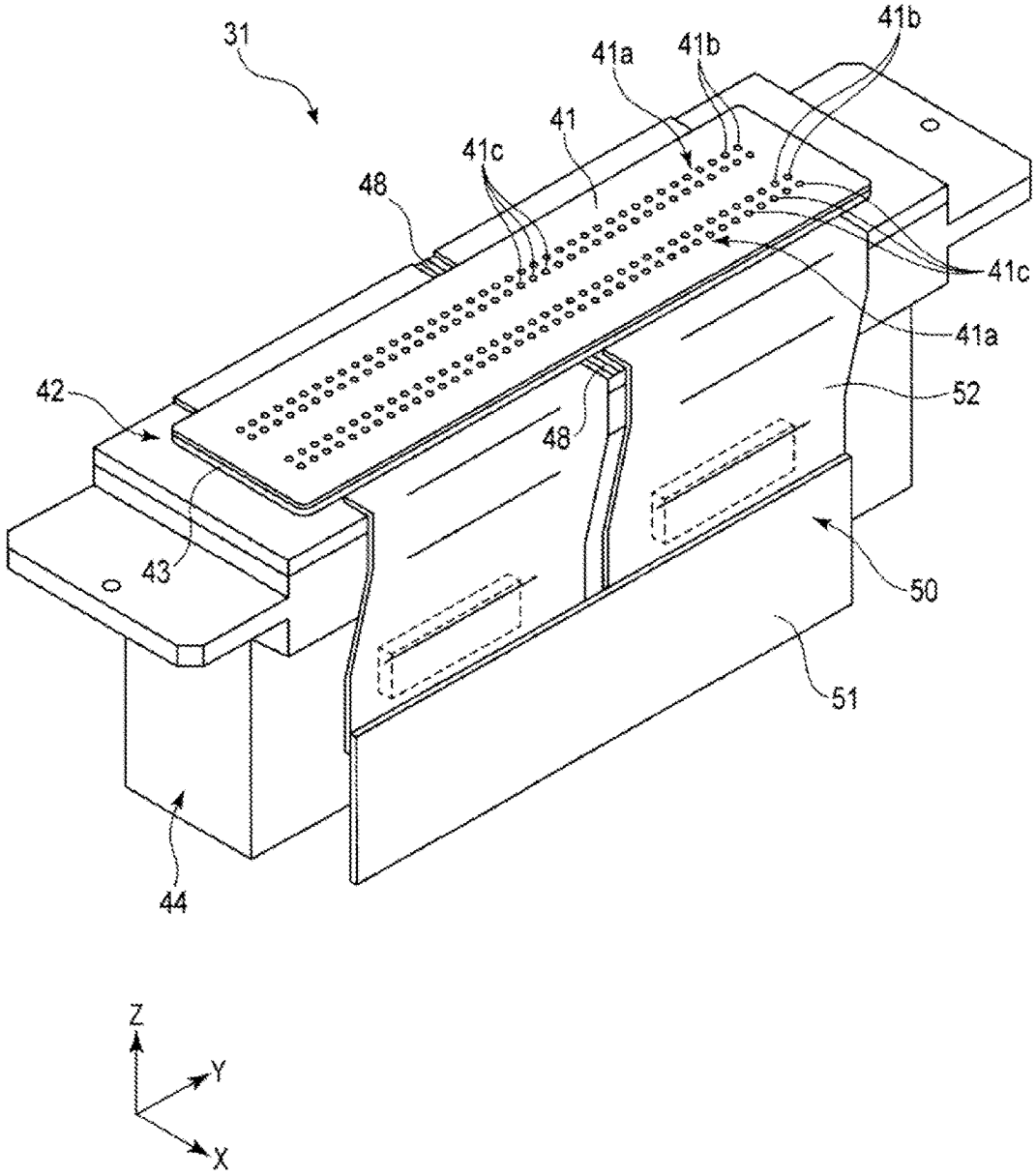
FIG. 2 is a perspective view of a liquid discharge head of a liquid discharge device.
Figure 3:
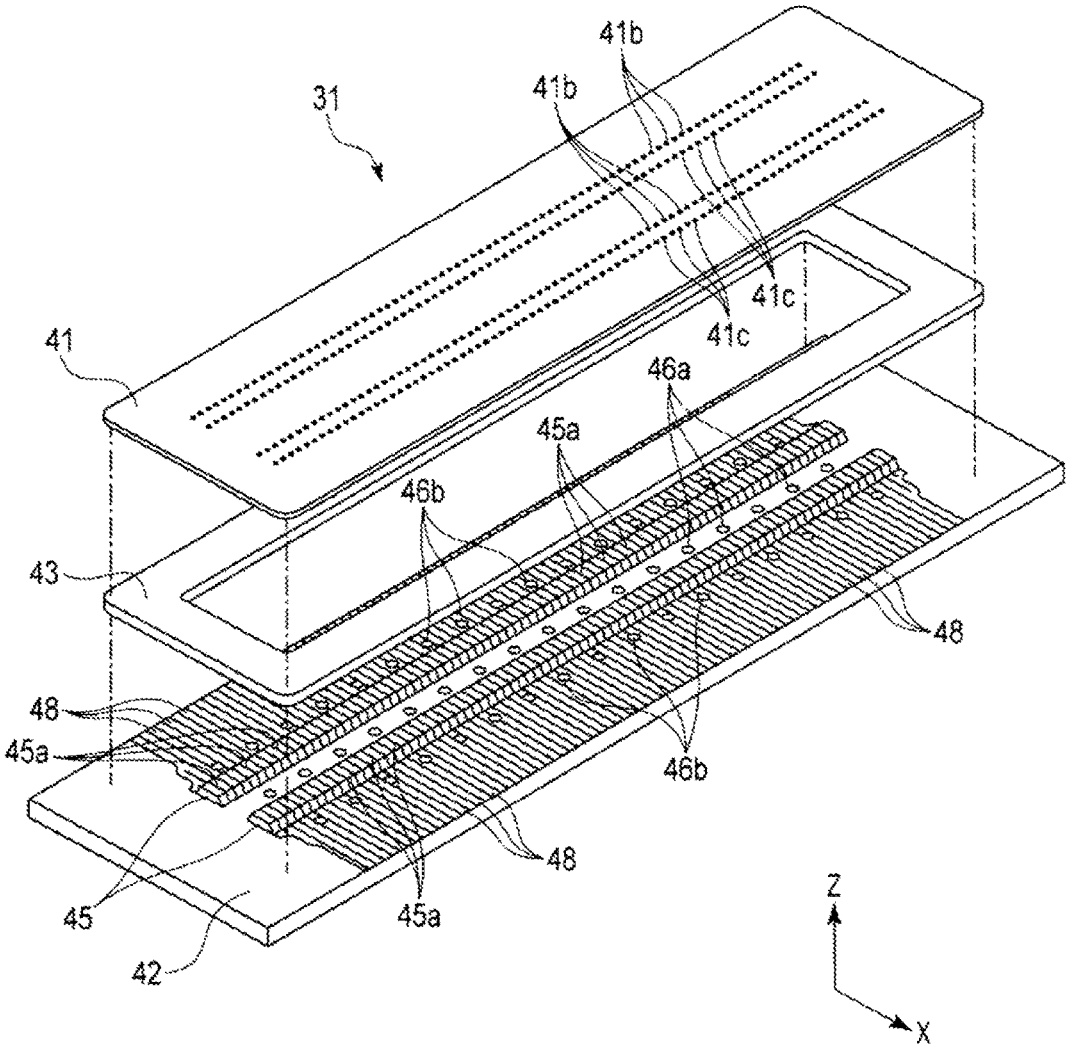
FIG. 3 is an exploded perspective view of a liquid discharge head.
Figure 4:
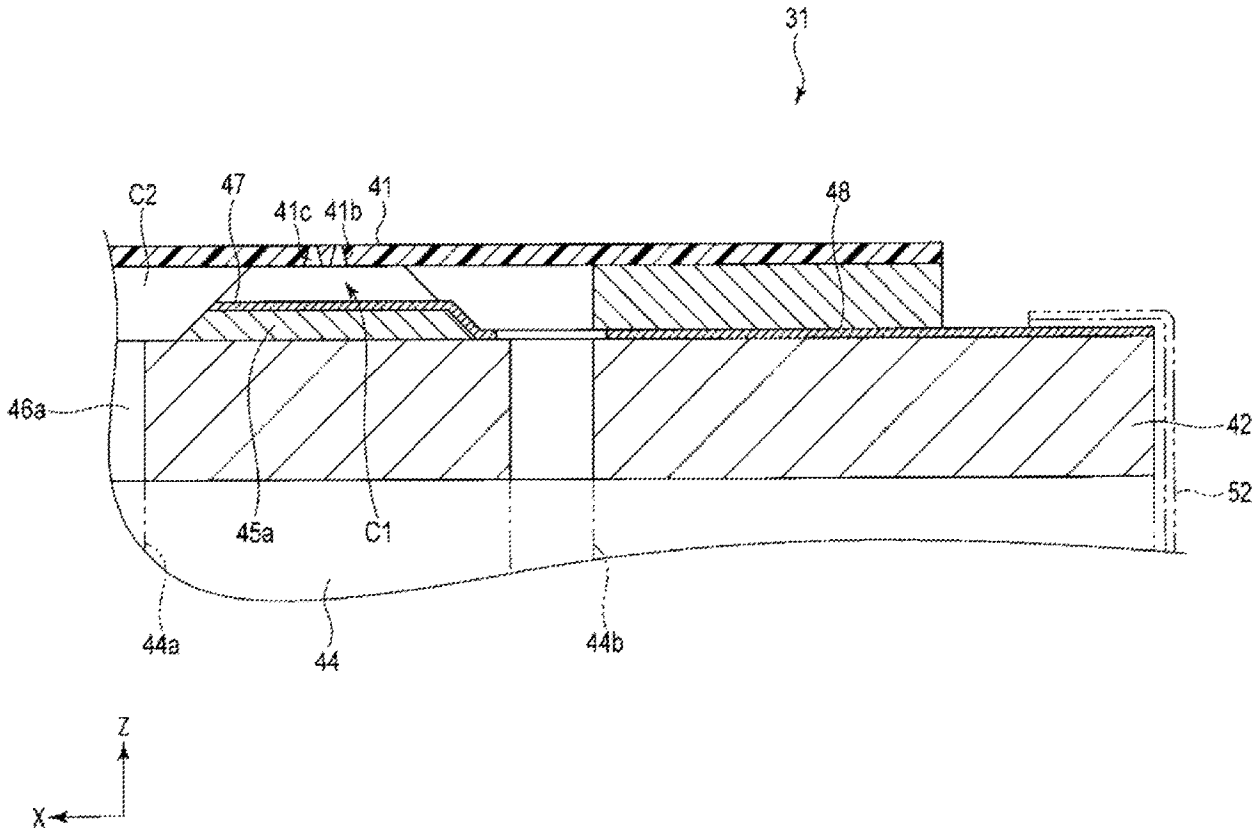
FIG. 4 is a cross-sectional view of a liquid discharge head.
Figure 5:
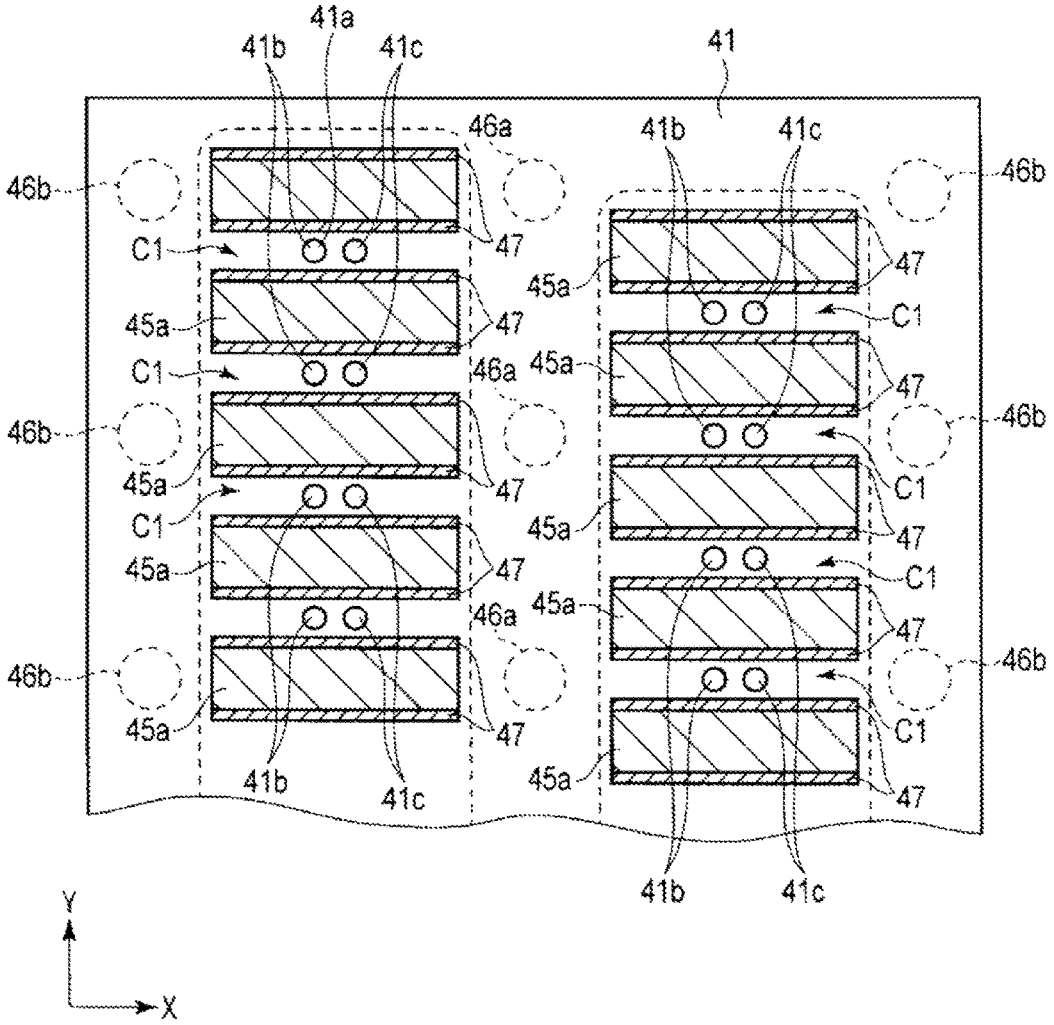
FIG. 5 is a cross-sectional view of a liquid discharge head.

Hereinafter, an inkjet recording device 1, as an example of a liquid discharge device, and an inkjet head 31, as an example of a liquid discharge head, according to a first embodiment, will be described with reference to FIGS. 1 to 6. FIG. 1 is an explanatory diagram of the inkjet recording device 1. FIG. 2 is a perspective view of the inkjet head 31. FIG. 3 is an exploded perspective view of the inkjet head 31. FIGS. 4 and 5 are cross-sectional views of the inkjet head 31. In the drawings, X, Y, and Z represent three directions intersecting at right angles. In the example embodiments depicted in the figures, the Z direction is corresponds to a direction paralleling the penetration direction of nozzle holes (e.g., 41*b* and 41*c*) through nozzle plate 41, but this is not a requirement or limitation.

As depicted in FIG. 1, the inkjet recording device 1 includes a housing 11, a medium feeding unit 12, an image forming unit 13, a medium ejecting unit 14, a conveying device 15, and a control unit 16.

The inkjet recording device 1 is a liquid discharge device that performs image forming processing on paper P by discharging a liquid, such as an ink, onto the paper P while conveying the paper P along a conveying path A1. The conveying path A1 extends from the medium feeding unit 12 to the medium ejecting unit 14 through the image forming unit 13.

The housing 11 forms an exterior of the inkjet recording device 1. The housing 11 includes an ejection port 11*a* from which the paper P is ejected to the outside.

The medium feeding unit 12 includes a plurality of paper feed cassettes 12*a* in the housing 11. The paper feed cassettes 12*a* are each formed in, for example, a box-like shape of a predetermined size with an opening on the upper side thereof, and are configured so that the paper feed cassettes 12*a* can hold stacks of sheets of paper P of various sizes.

The medium ejecting unit 14 includes an output tray 14*a* near the ejection port 11*a* of the housing 11. The output tray 14*a* is configured so that the output tray 14*a* can hold the paper P which is ejected from the ejection port 11*a*.

The image forming unit 13 includes a supporting unit 17 that supports the paper P and a plurality of head units 30 which are disposed above the supporting unit 17 so as to face the supporting unit 17.

The supporting unit 17 includes a conveying belt 18 in a form of a loop in a region in which an image is formed on the paper P, a support plate 19 which supports the conveying belt 18 from the back side thereof, and a plurality of belt rollers 20 which are provided on the backside of the conveying belt 18.

At the time of image formation, the supporting unit 17 conveys the paper P to the downstream side by supporting the paper P on a holding face 18*a* which is an upper face of the conveying belt 18 and moving the conveying belt 18 with predetermined timing by the rotation of the belt roller 20.

The head units 30 include a plurality of inkjet heads 31 of four colors, ink tanks 32 as liquid tanks mounted on the inkjet heads 31, connection flow channels 33 connecting the inkjet heads 31 and the ink tanks 32, and circulating pumps 34 which are circulating units. Each head unit 30 is a circulation-type head unit that continuously circulates the liquid from the ink tank 32 to a pressure chamber C1 and a common chamber C2 which are built into the inkjet head 31.

In the example embodiments described herein, as the inkjet heads 31, the inkjet heads 31C, 31M, 31Y, and 31K for four colors: cyan, magenta, yellow, and black are provided. As the ink tanks 32, the four ink tanks 32C, 32M, 32Y, and 32K are provided for these colors. Each ink tank 32 is connected to the inkjet head 31 via a connection flow channel 33. The connection flow channel 33 includes a supply flow channel 33*a*, which is connected to a supply port of the inkjet head 31, and a collecting flow channel 33*b*, which is connected to an exhaust port of the inkjet head 31.

Moreover, a negative pressure control device, such as a pump, is coupled to the ink tank 32 (not specifically depicted in the drawings). When the negative pressure control device applies a negative pressure to the ink tank 32 in response to liquid levels in the inkjet head 31 and the ink tank 32, the ink at each nozzle of the inkjet head 31 is made to have a meniscus of a predetermined shape.

Each circulating pump 34 is a liquid displacement pump which is configured from a piezoelectric pump, for example. The circulating pump 34 is connected to the supply flow channel 33*a*. The circulating pump 34 is electrically connected to a drive circuit of the control unit 16 by wiring such that the circulating pump 34 can be controlled by a central processing unit (CPU) 16*a* of the control unit 16. The circulating pump circulates the liquid via a circulating flow channel including the inkjet head 31 and the ink tank 32.

The conveying device 15 conveys the paper P along the conveying path A1 from the paper feed cassettes 12*a* of the medium feeding unit 12 to the output tray 14*a* of the medium ejecting unit 14 through the image forming unit 13. The conveying device 15 includes a plurality of guide plate pairs 21*a* to 21*h* and a plurality of conveying rollers 22*a* to 22*h* which are disposed along the conveying path A1.

Each of the plurality of guide plate pairs 21*a* to 21*h* includes a pair of plates which are disposed so as to face each other and place the paper P being conveyed therebetween, and guides the paper P along the conveying path A1.

The conveying rollers 22*a* to 22*h* include a paper feed roller 22*a*, conveying roller pairs 22*b* to 22*g*, and an ejection roller pair 22*h*. The conveying rollers 22*a* to 22*h* rotate driven in accordance with the CPU 16*a* of the control unit 16 and thereby move the paper P to the downstream side along the conveying path A1. Sensors that detect the paper conveying status are disposed in different parts of the conveying path A1.

The control unit 16 includes the CPU 16*a* which is a controller, read-only memory (ROM) that stores various programs and so forth, random-access memory (RAM) that temporarily stores, for example, various types of variable data and image data, and an interface unit that inputs data from the outside and outputs data to the outside.

As depicted in FIGS. 2 to 5, the inkjet head 31 includes a nozzle plate 41, a base plate 42, a frame 43, and a manifold 44.

The nozzle plate 41 is a rectangular plate. The nozzle plate 41 includes two nozzle sets 41*a*, each having a plurality of nozzle holes 41*b* in a line/row along the Y direction and a plurality of nozzle holes 41*c* in another line/row along the Y direction. A nozzle hole 41*b* is aligned in the X direction with a nozzle hole 41*c* and this pair communicates with a pressure chamber C1.

In the example embodiment described herein, a plurality of pressure chambers C1 are arranged in two lines along the Y direction, and the nozzle set 41*a* having two lines of nozzle holes is formed along the line of the pressure chambers C1. Each nozzle set 41*a* includes a plurality of pairs of nozzle holes 41*b* and nozzle holes 41*c*, each pair of which are aligned along the X direction (also referred to as a first direction) and communicate with one pressure chamber C1. One nozzle line has a plurality of nozzle holes 41*b* arranged in the Y direction (also referred to as a second direction), and the other nozzle line has a plurality of nozzle holes 41*c* arranged in the second direction. The second direction is a direction perpendicular to the first direction.

As depicted in FIG. 4, the nozzle holes 41*b* and 41*c* each have a flow channel in the shape of a truncated cone which is tapered so that the flow channel has a smaller flow channel diameter on a discharge face side opposite to the pressure chamber C1. The pair of nozzle holes 41*b* and 41*c* disposed so as to face the shared pressure chamber C1 thereby have different shapes so that the liquid is discharged from the nozzle hole 41*b* and the nozzle hole 41*c* at different discharge speeds on the discharge face. That is, when the paper P travels relative to the inkjet head 31 in the X direction from the nozzle 41*b* side to the nozzle 41*c* side, the pair of nozzle holes 41*b* and 41*c* are arranged side by side and have shapes such that a liquid discharge speed through the nozzle hole 41*b* is higher than a liquid discharge speed through the nozzle hole 41*c*.

Specifically, a flow channel diameter of the nozzle hole 41*b* the upstream side is smaller than a flow channel diameter of the nozzle hole 41*c* on the downstream side. That is, a flow channel diameter Dn1 on the discharge face side which is the minimum diameter of the flow channel of the cylindrical nozzle hole 41*b* is smaller than a flow channel diameter Dn2 on the discharge face side which is the minimum diameter of the flow channel of the nozzle hole 41*c*.

For example, the nozzle holes 41*b* and 41*c* can be configured so that, if the distance between the pair of nozzle holes 41*b* and 41*c* is assumed to be Pt, a relative travelling speed (also referred to as a feed speed) of the paper P is assumed to be V, a distance between the discharge face of the nozzle holes 41*b* and 41*c* and the paper P is assumed to be G, and the liquid discharge speeds of droplets from the nozzle holes 41*b* and 41*c* are assumed to be v1 and v2, respectively, then the relationship $2\times Pt>V\times G(v2-v1)/v1\times v2>0$ holds.

More preferably, the nozzle holes 41*b* and 41*c* can be configured so that, if the distance between the pair of nozzle holes 41*b* and 41*c* is assumed to be Pt, the feed speed is assumed to be V, the distance between the discharge face of the nozzle holes 41*b* and 41*c* and the paper P is assumed to be G, the liquid discharge speeds of the nozzle holes 41*b* and 41*c* are assumed to be v1 and v2, and the dot diameters of droplets Id from the nozzle holes 41*b* and 41*c* at the time of hitting the paper P are assumed to be DI1 and DI2, then the relationship $0.5\times DI2>Pt-V\times G(v2-v1)/v1\times v2\geq 0$ will hold.

The base plate 42 is a rectangle and bonded to the nozzle plate 41 so as to face the nozzle plate 41 with the frame 43 therebetween. The common chamber C2 is between the base plate 42 and the nozzle plate 41.

On a surface of the base plate 42 which faces the nozzle plate 41, piezoelectric blocks 45 are provided. Each of the piezoelectric blocks 45 includes a plurality of piezoelectric elements 45*a* which are aligned in the X direction and function as drive elements. The piezoelectric blocks 45 each have an elongated shape whose long side extends in the Y direction and include the plurality of piezoelectric elements 45*a* arranged in parallel. In the Y direction, a groove for forming the pressure chamber C1 is formed between adjacent piezoelectric elements 45*a*. The piezoelectric elements 45*a* are formed of, for example, a piezoelectric ceramic material such as lead zirconate titanate (PZT). On each surface of the piezoelectric elements 45*a* facing a pressure chamber C1, an electrode 47 is formed. The electrodes 47 are electrically connected to a circuit substrate 50 via wiring patterns 48.

A pair of piezoelectric blocks 45 is arranged such that the positions of the piezoelectric elements 45*a* of one piezoelectric block 45 are displaced from the positions of the piezoelectric elements 45*a* of the other piezoelectric block 45 in the Y direction by a half of the arrangement pitch of the piezoelectric elements 45*a*. That is, as depicted in FIG. 5, in the pressure chambers C1 formed in two lines, the positions of the pressure chambers C1 in one line are displaced from the positions of the pressure chambers C1 in the other line in the Y direction by a half of the distance between the adjacent pressure chambers C1 in the Y direction. As a result, the droplets Id hit the paper P at the intervals of a half of the pressure chamber C1 pitch.

The base plate 42 has supply holes 46*a* and collecting holes 46*b*. The supply holes 46*a* are through-holes passing thorough the base plate 42 in a thickness direction and communicate with a supply channel 44*a* of the manifold 44. The collecting holes 46*b* are through-holes passing through the base plate 42 in the thickness direction and communicate with a collecting channel 44*b* of the manifold 44.

The frame 43 is a rectangular frame and disposed between the base plate 42 and the nozzle plate 41. The frame 43 has a predetermined thickness and forms the common chamber C2 between the base plate 42 and the nozzle plate 41.

The manifold 44 is a rectangular block and bonded to the base plate 42. The manifold 44 has ink flow channels that communicate with the common chamber C2, each ink flow channel includes supply channel 44*a* and collecting channel 44*b*. The supply channel 44*a* is fluidly connected to the supply flow channel 33*a*, and the collecting channel 44*b* is fluidly connected to the collecting flow channel 33*b*. On the outer surface of the manifold 44, the circuit substrate 50 is provided. The circuit substrate 50 includes a drive IC 51. The drive IC 51 is electrically connected to the electrodes 47 of the piezoelectric elements 45*a* via a flexible printed circuit (FPC) 52 and the wiring patterns 48.

When the nozzle plate 41, the base plate 42, the frame 43, and the manifold 44 are assembled together as described, the inkjet head 31 is formed and provides a plurality of pressure chambers C1 therein and ink flow channels connecting these pressure chambers. The plurality of pressure chambers C1 are separated from one another by the piezoelectric elements 45*a* serving as dividing walls.

An operation of the inkjet recording device 1 configured as described above will be described below. The CPU 16*a* detects via an interface, for example, a printing instruction input by a user from an operation input unit. When detecting the printing instruction, the CPU 16*a* controls the conveying device 15 to convey paper P and outputs a print signal to the head units 30 at a predetermined timing to drive the inkjet head 31. Based on an image signal corresponding to image data, the piezoelectric elements 45*a* are selectively drive such that ink is discharged from the nozzle holes 41*b* and 41*c* adjacent to each piezoelectric element 45*a*, and thereby an image on is formed on the paper P held on the conveying belt 18.

During a liquid discharge operation, the CPU 16*a* controls the drive circuit to apply a drive voltage to the electrodes 47 on the piezoelectric elements 45*a* via the wiring patterns 48 to deform the piezoelectric elements 45*a*. For instance, when the piezoelectric elements 45*a* is driven as to increase the capacity of the pressure chamber C1 and create a negative pressure in the pressure chamber C1, the ink is set back into the pressure chamber C1. When the piezoelectric elements 45*a* is driven as to reduce the capacity of the pressure chamber C1 apply pressure to the inside of the pressure chamber C1, ink droplets Id are discharged from a pair of the nozzle holes 41*b* and 41*c* disposed so as to face the pressure chamber C1. Then, the droplets Id are sprayed onto the paper P disposed so as to face the pair of nozzle holes 41*b* and 41*c*.

The CPU 16*a* controls the circulating pumps 34 to circulate the liquid through the circulating flow channels passing through the ink tanks 32 and the inkjet heads 31. By a circulating operation, the ink in the ink tanks 32 flows into the common chamber C2 having a flow channel unit through supply ports (not specifically depicted in the drawings) and is supplied to the plurality of pressure chambers C1.

Figure 6:
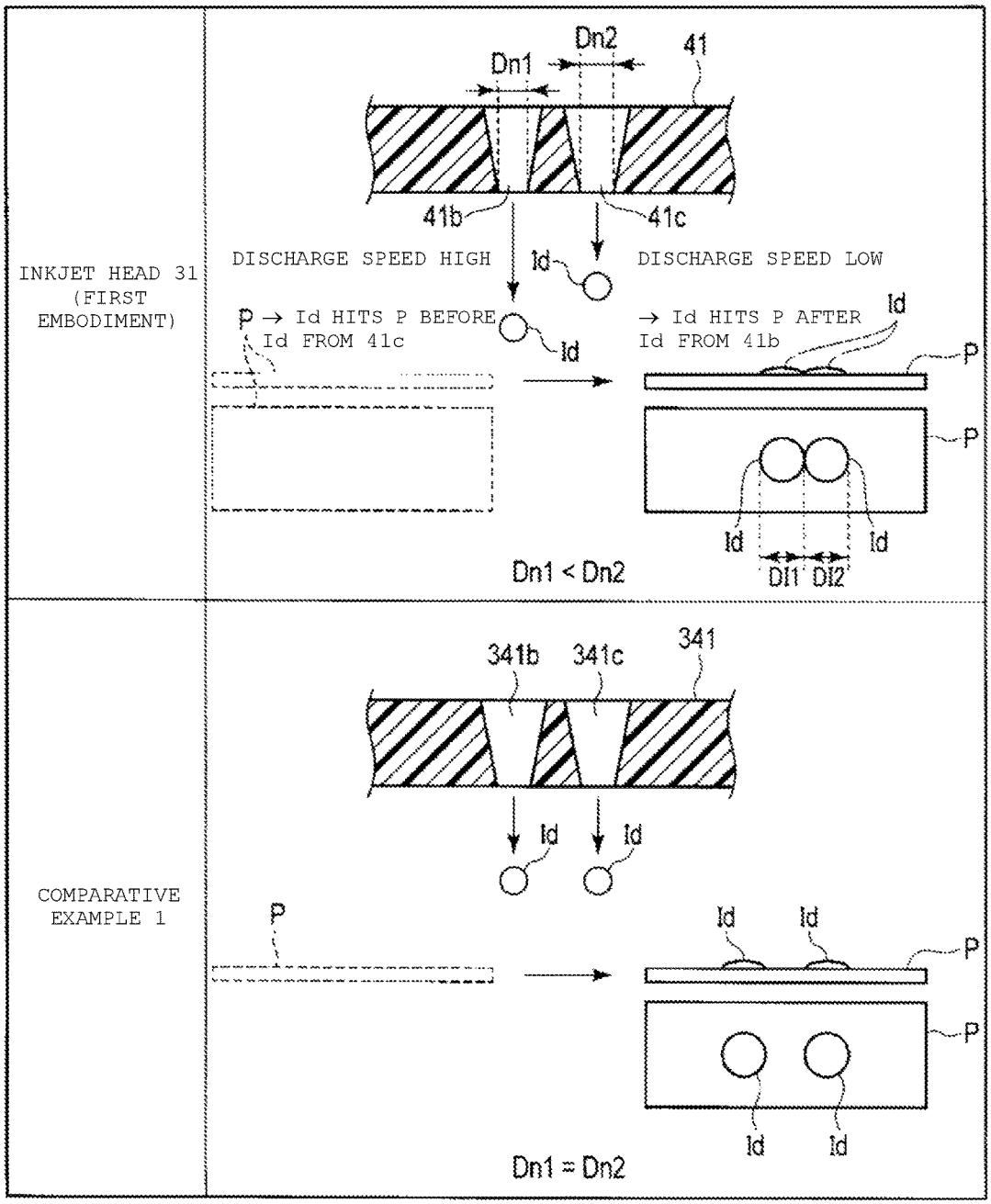
FIG. 6 is an explanatory diagram of nozzle holes of a liquid discharge head.

As depicted in FIG. 6, in each inkjet head 31, a pair of nozzle holes 41*b* and 41*c* shares a pressure chamber C1 and have different shapes causing different discharge speeds. Thus, timings at which droplets from the nozzle holes 41*b* and 41*c* hit the paper P are different. Specifically, the droplet from the nozzle hole 41*c* on the downstream side hits the paper P after the droplet from the nozzle hole 41*b* on the upstream side. For this reason, a distance between the positions where the droplets Id from the nozzle holes 41*b* and 41*c* hit the paper P becomes narrower than the distance between the nozzle holes 41*b* and 41*c*. When the paper P passes from the nozzle hole 41*b* side to the nozzle hole 41*c* side, the droplet from the nozzle hole 41*b* hits the paper P passes before the nozzle hole 41*c* hits the paper P. The droplet from the nozzle hole 41*c* is discharged after the droplet from the nozzle hole 41*b* is discharged, and hits a position on the paper P on or near the position the droplet from the nozzle hole 41*b* hits. Thus droplets from a pair of nozzle holes 41*b* and 41*c* may hit a same position, or positions having a distance that is narrower than at least the distance between the pair of nozzle holes 41*b* and 41*c* within a small area on the paper P.

In Comparative Example 1, as depicted in FIG. 6, a nozzle plate 341 includes nozzle holes 341*b* and 341*c* having the same shape. Droplets from the nozzle holes 341*b* and 341*c* hit the travelling paper P at a same timing. In this case, the positions on the paper P that droplets from the nozzle holes 341*b* and 341*c* hit are separated from each other by the same distance as the distance between the nozzle holes 341*b* and 341*c*. Thus, the droplets Id are separated from each other or get longer in the direction the paper P travels.

In the inkjet head 31 according to the first embodiment described above, since the condition: $2\times Pt>V\times G(v2-v1)/v1\times v2>0$ holds, a shape of an area of the paper P droplets hit is closer to one circle.

For example, flow channel diameters of nozzle holes 41*b* and 41*c* are set so that the discharge speed v1 of the nozzle hole 41*b* is 11 m/sec and the discharge speed v2 of the nozzle hole 41*c* is 9 m/sec. If the distance G between the discharge face of the nozzle holes 41*b* and 41*c* and the paper P is set at 3 mm and the feed speed V of the paper P is set at 800 mm/sec (48 m/min), the distance between the positions on the paper P that droplets from the nozzle holes 41*b* and 41*c* hit is smaller than the distance between the nozzle holes 41*b* and 41*c* by about 48.5 μm. In this case, if the distance Pt between the nozzles holes 41*b* and 41*c* is set at 48.5 μm, a condition: $V\times G(v2-v1)/v1\times v2=Pt$ holds and the positions that droplets from the nozzle holes 41*b* and 41*c* hit coincide with each other, whereby the droplets overlap each other in a circle.

As for the dot diameters of droplets at the time of hitting the paper P, if the dot diameter of the droplet Id from the nozzle hole 41*b* is set at DI1 and the dot diameter of the droplet Id from the nozzle hole 41*c* is set at DI2, when a condition: $0.5\times DI2>Pt-V\times G(v2-v1)/v1\times v2\geq 0$ holds, the positions that droplets from the nozzle holes 41*b* and 41*c* hit coincide with each other. That is, with the inkjet head 31 according to the first embodiment described above, variations in a dot shape are reduced as a result of a droplet hitting an area smaller than or equal to half an area of the dot diameter of droplets that already hit the paper P.

It is to be noted that the particular embodiments explained above are some possible example of a liquid discharging device and do not limit the possible configurations, specifications, specifications, or the like of liquid discharging devices according to the present disclosure.

Figure 7:
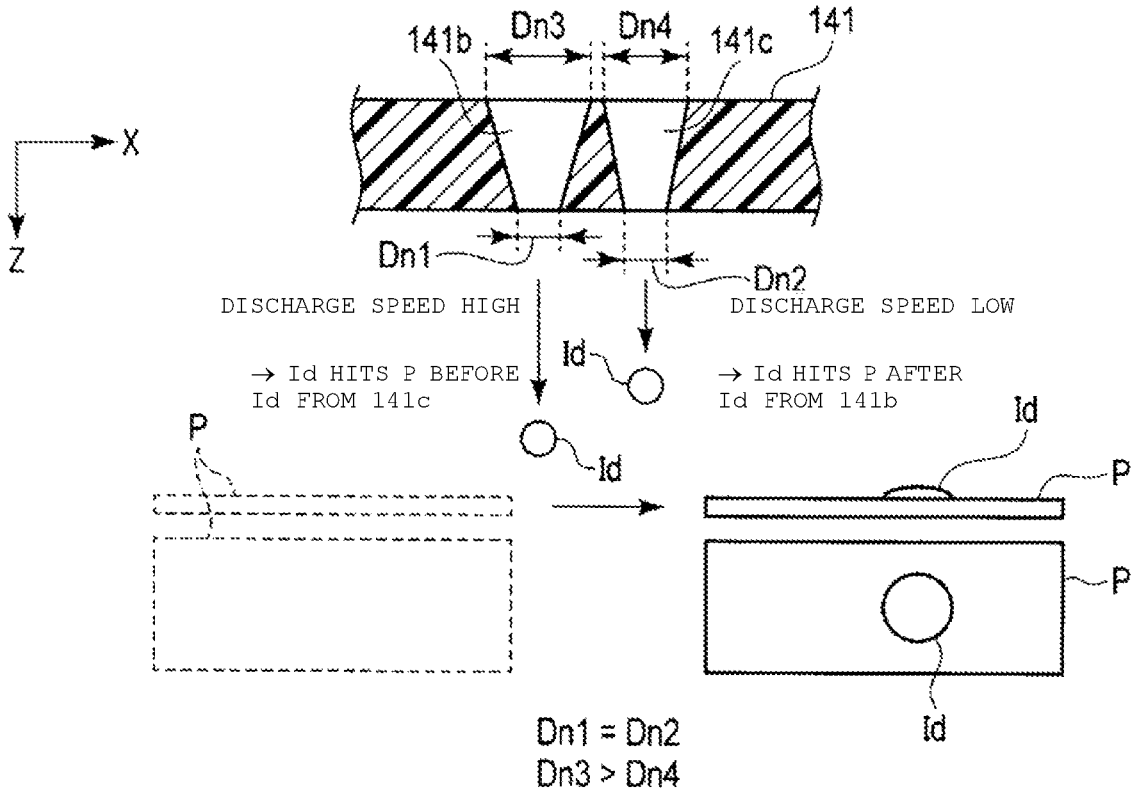
FIG. 7 is a cross-sectional view of a liquid discharge head according to a second embodiment.

In the first embodiment described above, as a configuration changing discharge speeds from different nozzle holes different, the flow channel diameters of the nozzle holes 41*b* and 41*c* on the discharge face are made different, but the configuration is not limited thereto. For instance, in a second embodiment, as depicted in FIG. 7, a nozzle plate 141 may include the nozzle holes 141*b* and 141*c* having same flow channel diameters Dn1=Dn2 on the discharge face, but different opening diameters Dn3>Dn4 (>Dn1=Dn2) on the base plate 42 side, when the paper P travels from the nozzle hole 141*b* side to the nozzle hole 141*c* side. Specifically, the nozzle hole 141*b* has a steeper slope from the base plate 42 side to the discharge face than the nozzle hole 141*c*. That is, even when the flow channel diameters of nozzle holes 141*b* and 141*c* on the discharge face are the same, the liquid flows through the flow channel of the nozzle hole 141*b* having a steeper slope at higher speed than the flow channel of the nozzle hole 141*c*. Thus, the nozzle holes 141*b* and 141*c* may have different tapered angles, same flow channel diameters (Dn1=Dn2), and different opening diameters (Dn3>Dn4). Since the speeds of flow of the liquid flowing through the nozzle holes 141*b* and 141*c* can be made different so that the speed of flow of the liquid flowing through the nozzle hole on the upstream side is higher than the speed of flow of the liquid flowing through the nozzle hole on the downstream side, as in the case of the first embodiment described above, a desired droplet hit shape can be obtained by making the hit positions of the droplets which are discharged from the nozzle holes 141*b* and 141*c* closer to each other or coincide with each other.

Figure 8:
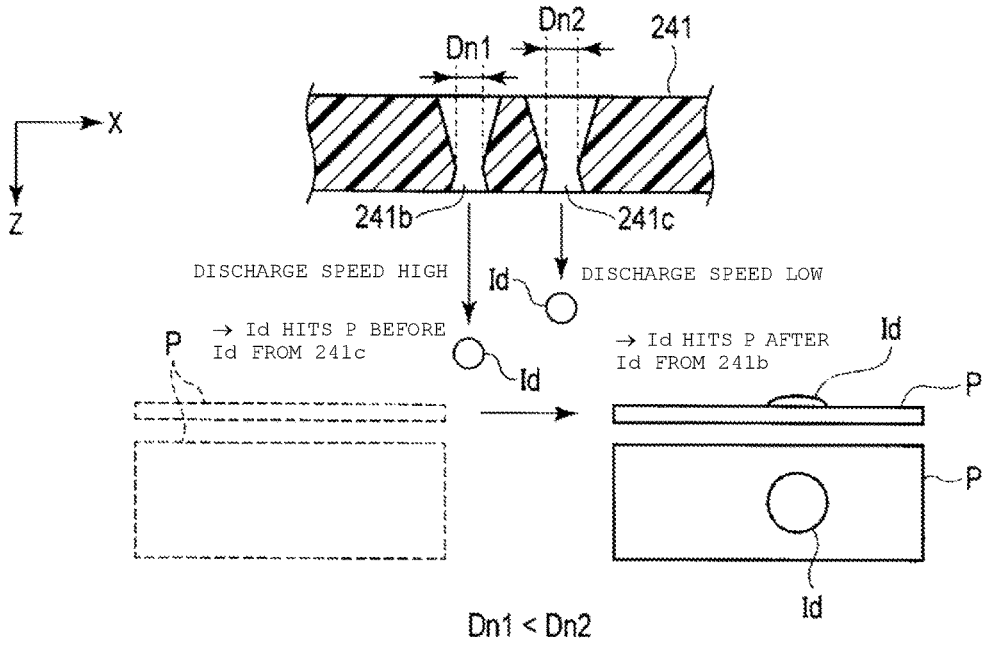
FIG. 8 is a cross-sectional view of a liquid discharge head according to a third embodiment.

Moreover, the flow channel diameters of the nozzle holes may be made different at a midpoint in the nozzle holes, instead of on the discharge face. For instance, in third embodiment depicted in FIG. 8, a nozzle plate 241 may include nozzle holes 241*b* and 241*c* having narrowed parts at a midpoint in the nozzle holes 241*b* and 242*c*, where the nozzle holes 241*b* and 241*c* have minimum diameters Dn1 and Dn2, respectively. In FIG. 8, the minimum diameters are set so that Dn1<Dn2, and thus the flow speeds of liquid through the nozzle holes 241*b* and 241*c* can be made different. Specifically, the liquid flows through the nozzle hole on the upstream side at a higher speed than the liquid flows through the nozzle hole on the downstream side, as in the case of the first embodiment described above, the hit positions of the droplets can be made closer to each other or to coincide with each other, whereby a desired droplet hit shape can be obtained.

The shapes and structures of elements such as pressure chambers and piezoelectric elements are also not limited to the shapes and structures in the above-described embodiments.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid discharge head, comprising:

a pressure chamber; and a nozzle plate having a plurality of nozzle holes formed therein and a discharge face with an upstream side and a downstream side, the plurality of nozzle holes being in fluid communication with the pressure chamber and including:

a first nozzle hole on the upstream side of the discharge face, and a second nozzle hole on the downstream side of the discharge face, wherein a liquid discharge speed from the first nozzle hole is higher than a liquid discharge speed from the second nozzle hole, wherein a relationship $0.5\times DI2>Pt-V\times G(v2-v1)/v1\times v2\geq 0$ holds when a distance between the first and the second nozzles is Pt, the feed speed of the paper is V, a distance between the discharge face of the first and the second nozzles and the paper is G, liquid discharge speeds of the first and second nozzle holes are v1 and v2, and dot diameters of liquid droplets discharged from the first and the second nozzle holes at a time of hitting the paper are DI1 and DI2.

2. The liquid discharge head according to claim 1, wherein the plurality of nozzle holes is aligned in two lines along a direction perpendicular to a direction from the upstream side to the downstream side of the discharge face.

3. The liquid discharge head according to claim 1, wherein a flow channel diameter at the discharge face of the first nozzle hole is smaller than a flow channel diameter at the discharge face of the second nozzle hole.

4. The liquid discharge head according to claim 1, wherein a flow channel of the first nozzle hole is tapered at a first angle, and a flow channel of the second nozzle hole is tapered at a second angle that is smaller than the first angle.

5. The liquid discharge head according to claim 1, wherein a minimum flow channel diameter of the first nozzle hole within the nozzle plate is smaller than a minimum flow channel diameter of the second nozzle hole within the nozzle plate.

6. The liquid discharge head according to claim 1, wherein a relationship:

$$2\times Pt>V\times G(v2-v1)/v1\times v2>0$$

holds.

7. A liquid discharge device comprising:

a conveying device configured to convey a discharge target in a first direction;

a pressure chamber; and a nozzle plate having a plurality of nozzle holes formed therein and a discharge face with an upstream side and a downstream side along the first direction, the plurality of nozzle holes being in fluid communication with the pressure chamber and including:

a first nozzle hole on the upstream side of the discharge face, and a second nozzle hole on the downstream side of the discharge face, wherein a liquid discharge speed from the first nozzle hole is higher than a liquid discharge speed from the second nozzle hole, wherein a relationship $0.5\times DI2>Pt\times V\times G(v2-v1)/v1\times v2\geq 0$ holds when a distance between the first and the second nozzles is Pt, the feed speed of the paper is V, a distance between the discharge face of the first and the second nozzles and the paper is G, liquid discharge speeds of the first and second nozzle holes are v1 and v2, and dot diameters of liquid droplets discharged from the first and the second nozzle holes at a time of hitting the paper are DI1 and DI2.

8. The liquid discharge device according to claim 7, wherein the plurality of nozzle holes is aligned in two lines along a direction perpendicular to a direction from the upstream side to the downstream side of the discharge face.

9. The liquid discharge device according to claim 7, wherein a flow channel diameter at the discharge face of the first nozzle hole is smaller than a flow channel diameter at the discharge face of the second nozzle hole.

10. The liquid discharge device according to claim 7, wherein a flow channel of the first nozzle hole is tapered at a first angle, and a flow channel of the second nozzle hole is tapered at a second angle that is smaller than the first angle.

11. The liquid discharge device according to claim 7, wherein a minimum flow channel diameter of the first nozzle hole within the nozzle plate is smaller than a minimum flow channel diameter of the second nozzle hole within the nozzle plate.

12. The liquid discharge device according to claim 7, wherein a relationship:

$$2\times Pt>V\times G(v2-v1)/v1\times v2>0$$

holds.

13. A liquid discharge device, comprising:

a nozzle plate having a first nozzle set and a second nozzle set spaced from each other in a first direction, each nozzle set including a plurality of first nozzle holes disposed in a line along a second direction crossing the first direction and a plurality of second nozzle holes disposed in another line along the second direction;

a frame bonded to the nozzle plate;

a base plate having a plurality of piezoelectric element corresponding to nozzle holes of the nozzle plate, the base plate bonded to the frame, the frame being between the base plate and the nozzle plate; and a plurality of pressure chambers formed between the base plate and the nozzle plate and a piezoelectric element being between adjacent pressure chambers in the second direction, each pressure chamber being fluidly connected to one first nozzle hole and one second nozzle hole of the same nozzle set and aligned with each other in the first direction, wherein each first nozzle hole has a first liquid discharge speed, and each second nozzle hole has a second liquid discharge speed, the first liquid discharge speed is higher than the liquid discharge speed, and a relationship $0.5\times DI2>Pt\times V\times G(v2-v1)/v1\times v2\geq 0$ holds when a distance between the first and the second nozzles is Pt, the feed speed of the paper is V, a distance between the discharge face of the first and the second nozzles and the paper is G, liquid discharge speeds of the first and second nozzle holes are v1 and v2, and dot diameters of liquid droplets discharged from the first and the second nozzle holes at a time of hitting the paper are DI1 and DI2.

14. The liquid discharge device according to claim 13, further comprising:

a conveying device configured to convey a discharge target in the first direction.

15. The liquid discharge device according to claim 13, wherein a flow channel diameter at the discharge face of the first nozzle hole is smaller than a flow channel diameter at the discharge face of the second nozzle hole.

16. The liquid discharge device according to claim 13, wherein a flow channel of the first nozzle hole is tapered at a first angle, and a flow channel of the second nozzle hole is tapered at a second angle that is smaller than the first angle.

17. The liquid discharge device according to claim 13, wherein a minimum flow channel diameter of the first nozzle hole within the nozzle plate is smaller than a minimum flow channel diameter of the second nozzle hole within the nozzle plate.

18. The liquid discharge device according to claim 13, wherein a relationship:

$$2\times Pt>V\times G(v2-v1)/v1\times v2>0$$

holds.

* * * * *